US005081474A

United States Patent [19]

Shibata et al.

[11] Patent Number: 5,081,474

[45] Date of Patent: Jan. 14, 1992

[54] RECORDING HEAD HAVING MULTI-LAYER MATRIX WIRING

[75] Inventors: Makoto Shibata, Hiratsuka; Masami Kasamoto, Ayase; Shuji Koyama, Hiratsuka; Sakai Yokoyama, Isehara; Toshihiro Mori, Hiratsuka, all of Japan

[73] Assignee: Canon Kabushiki Kaisha, Tokyo, Japan

[21] Appl. No.: 618,584

[22] Filed: Nov. 28, 1990

Related U.S. Application Data

[63] Continuation of Ser. No. 374,839, Jul. 3, 1989, abandoned.

[30] Foreign Application Priority Data

Jul. 4, 1988 [JP] Japan ..... 63-166165
Jun. 13, 1989 [JP] Japan ..... 1-150155

[51] Int. Cl.[5] ..... B41J 2/05
[52] U.S. Cl. ..... 346/140 R
[58] Field of Search ..... 346/140

[56] References Cited

U.S. PATENT DOCUMENTS

| | | | |
|---|---|---|---|
| 4,353,079 | 10/1982 | Kawanabe | 346/140 |
| 4,429,321 | 1/1984 | Matsumoto | 346/140 |
| 4,458,256 | 7/1984 | Shirato | 346/140 |
| 4,559,543 | 12/1985 | Toganoh et al. | 346/140 R |
| 4,600,931 | 7/1986 | Terasawa | 346/140 R |
| 4,635,080 | 1/1987 | Watanabe | 346/140 R |
| 4,719,477 | 1/1988 | Hess | 346/140 |
| 4,723,129 | 2/1988 | Endo et al. | 346/1.1 |

*Primary Examiner*—Joseph W. Hartary
*Attorney, Agent, or Firm*—Fitzpatrick, Cella, Harper & Scinto

[57] ABSTRACT

A recording head has a liquid channel defining member for defining a liquid channel communicated to a discharging opening for discharging ink, and a base member having a plurality of electricity-heat converting elements for generating heat to be transmitted to the ink filling the liquid channel. A matrix wiring portion is connected electrically to the electricity-heat converting elements, respectively. The matrix wiring portion has a multi-layer constitution having a first wiring and a second wiring. The second wiring is provided through an insulating layer on the first wiring, and the plurality of electricity-heat converting elements are provided on the insulating layer.

65 Claims, 14 Drawing Sheets

RECORDING HEAD HAVING MULTI-LAYER MATRIX WIRING

This application is a continuation of application Ser. No. 07/374,839 filed July 3, 1989, now abandoned.

BACKGROUND OF THE INVENTION

1. Field of the Invention

This invention relates to a recording device to be used for copying machine, facsimile, word processor, printer for output of computer, etc., particularly to a recording head which performs recording by utilizing heat energy and a recording device having said recording head mounted thereon.

2. Related Background Art

First, description is made about the background art before the present inventors accomplished the present invention by referring to an ink jet recording head which can preferably practice the present invention as an example.

For example, as shown in U.S. Pat. No. 4,723,129 (Endo et al), there is an ink jet recording head suitable for performing a recording method to form an image by use of a recording liquid, which forms at least one droplet of a recording liquid (ink) by utilizing heat energy. The ink jet recording device having such recording head mounted thereon has been used as a printer 100 as shown in FIG. 1A. FIG. 1B shows the main constitution of recording head, etc. of the printer shown in FIG. 1A. Here, the ink jet recording head 401 receives the electrical signals from the driving circuit 408 and, while moving along the guide rail 402, attaches droplets on the recording paper 404 as the recording medium carried by the platen 403 and held at a predetermined recording position, thereby effecting recording of letters, graphics, etc. with dot pattern.

Here, 406 is an ink tank for housing the ink to be used for recording, which is detachably mounted on the ink jet recording device and supplies ink through the supplying tube 407 to the recording head 401.

Numeral 405 is a discharging recovery device, which is provided to bring the ink discharging state of the recording head 401 into good state before performing recording (see U.S. Pat. No. 4,600,931, Terasawa).

Next, the structure of the ink jet recording head of the prior art is described by use of FIGS. 2A and 2B.

FIG. 2A shows a heater 501 and a pair of electrodes 502 for forming an electricity-heat converting element as an energy generating means which generates energy to be utilized for discharging of ink. The electrodes 502, for receiving supply (transmission) of signals from outside, have the portion shown by 502*a* electrically connected to the driving circuit not shown by wire bonding, etc. The cross-section of the ink jet recording head cut along the line 2B—2B in FIG. 2A is shown in FIG. 2B.

The heater 501 and the electrodes 502 are constituted basically of a heat-generating resistance layer 501-1 formed through an intermediary insulating layer 503 on the substrate 505 and an electroconductive layer formed by patterning on said heat-generating resistance layer 501-1. The insulating layer 503 comprises an insulating material such as $SiO_2$, SiN, etc. And, the insulating layer 503 is provided for the purpose of electrical insulation when the substrate 505 is formed of a material of a metal or semiconductor, etc. and additionally for the purpose of accumulating moderately the heat energy generated at the heater 501 and transmitting the heat with good efficiency into the liquid channel (nozzle) 506 filled with ink. However, for example, if the insulating layer 503 is too thick and accumulates too much heat, the temperature of the ink as a whole is elevated, whereby the physical property values of ink change and no stable droplet formation for obtaining good images can be effected. For this reason, the thickness of the heat accumulating layer may be suitably 2 to 5 μm in the case of, for example, the material as described above.

Further, on the heater 501 and the electrodes 502, protective layers (504 and 507 in the drawing) are formed at their upper parts for the purpose of shielding these from ink. As the material constituting the protective layer, for example, inorganic materials such as $SiO_2$, SiN, etc. may be employed for the first protective layer 504, and inorganic materials such as $SiO_2$, SiN, etc. for the second protective layer 507. Also, in the vicinity of the heat-generating portion for generating bubbles to cause the ink to undergo change in state with heat, cavitation resistance layer 508 is formed for the purpose of preventing damage in the vicinity of the heat-generating portion by cavitation during shrinkage and disappearance of the bubbles generated. As the material constituting the cavitation resistance layer, for example, inorganic materials such as Ta, Ti, Cr, etc. may be employed.

In the prior art, for example, in a head having a structure described in U.S. Pat. No. 4,559,543 (Toganoh et al), since the supplying means of driving signals is provided separately from the substrate on which the electricity-heat converting element is formed, the head was electrically connected to the supplying means by wire bonding, etc. For this reason, when a large number of nozzles are arranged at high density, the area occupied by the signal connecting portions becomes larger than the area occupied by the nozzle portion, whereby not only the head is enlarged to bring about troubles in operability, but also the cost of material cost, etc. is increased.

Particularly, in a recording head in the form in which the ink tank for housing ink to be supplied to head is constituted integrally with head, and mounted detachably in the carriage of the ink jet recording device (see U.S. Pat. No. 4,635,080, Watanabe), since it is one of great factors for commercial success to produce a recording head at low cost and provide it at inexpensive price, the present inventors have investigated by carrying out a large number of experiments repeatedly in order to develop a recording head with a novel constitution.

Also, as one having a constitution different from the recording head with the constitution as disclosed U.S. Pat. No. 4,559,543 Togonoh et al as described above, there is a head in the form as described in U.S. Pat. No. 4,429,321 Matsumoto. This has been accomplished as the result of finding that the semiconductor related techniques can be applied to the head which performs recording by utilizing heat energy as described above, and a transistor as the driving element is made on the single crystal silicon substrate and an electricity-heat converting element is formed by thin film technique. However, in a head for high density and high resolution recording having as many as several tens to several hundreds of discharging orifices and electricity-heat converting elements as used in recent years, the number of individual electrodes of the respective electricity-heat converting elements is also increased, whereby it is difficult to effect miniaturization and reduced cost of the head.

Accordingly, it is required to have a constitution in which a plurality of electricity-heat converting elements is divided into, for example, M groups each of N elements to effect N×M matrix wiring, and current is passed selectively through the electricity-heat converting elements according to block driving such as time sharing driving. Such constitution is described by use of FIG. 3.

In FIG. 3, $R_{11}$–$R_{MN}$ are electricity-heat converting elements, C-1–C-M are common wirings of respective groups, S-1–S-N are common signal selection wirings, and by selecting respectively the group wiring and the common signal selection wiring and effecting conduction therebetween, driving of desired electricity-heat converting element can be done.

At this time, for breaking the circuits passing through other electricity-heat converting elements, to each of the group wiring is required to be connected a diode for prevention of reverse current at a part of the driving circuit.

Accordingly, the present inventors have progressed the investigations and consequently found that the recording head as described below is a suitable constitution.

That is, its constitution is that a diode array is made within the substrate on which electricity-heat converting elements are formed, by use of Si as the substrate material, and driving is effected by time sharing. As described above, by making diodes within the substrate, for example, for one having 64 electricity-heat converting elements, for which in the prior art one common electrode and 64 individual electrodes, namely at least 65 as the total of connection numbers and area therefor have been required, only 18 connection numbers and area therefor are required, whereby the number of steps necessary for connection and area can be lowered to accomplish miniaturization of the ink jet recording head.

Also, as accompanied with such miniaturization, the number of ink jet recording heads which can be prepared from one Si wafer is increased, and therefore cost-down to great extent can be also accomplished.

In addition by making the diode array within the head, the head size as a whole can be miniaturized, and not only the material cost of the head but also the cost of the surrounding circuit can be further lowered to great extent.

However, even in a recording head by matrix driving as described above, the wiring itself of the matrix circuit is complicated, and there is still room to be improved for effecting miniaturization and reduction in cost of head.

Particularly, in a recording head to be applied to the ink jet recording device as described above, it is difficult to obtain good images unless the influence of heat given to ink, propagation of vibration of ink accompanied with discharging, channel resistance, etc. are sufficiently taken into consideration.

SUMMARY OF THE INVENTION

The present invention has been accomplished in order to solve the technical problems as described above.

An object of the present invention is to provide a recording head and a recording device miniaturized at high density at low cost.

Another object of the present invention is to produce high performance recording head and recording device capable of forming an image of high resolution at low cost.

Still another object of the present invention is to provide a recording head and a recording device which has good discharging characteristics and can perform stable discharging of ink.

Still another object of the present invention is to provide a recording head and a recording device in which the matrix circuit for driving the recording head can be prepared easily.

Still another object of the present invention is to provide a recording head, having:

a liquid channel defining member for defining a liquid channel communicated to a discharging opening for discharging ink, and a base member having a plurality of electricity-heat converting elements for generating heat to be transmitted to the ink filling said liquid channel, and a matrix wiring portion connected electrically to said electricity-heat converting elements respectively, said matrix wiring portion having a multi-layer constitution having a first wiring and a second wiring provided through an insulating layer on said first wiring, and said plurality of electricity-heat converting elements being provided on said insulating layer.

Still another object of the present invention is to provide a recording head, having:

a liquid channel defining member for defining a liquid channel communicated to the discharging opening for discharging an ink, and a substrate comprising a plurality of electricity-heat converting elements for generating heat to be transmitted to the ink filling said liquid channel arranged through a heat-accumulating layer thereon, said recording head having a matrix wiring portion arranged on said substrate and electrically connected to said electricity-heat converting elements respectively, said matrix wiring portion having a multi-layer wiring structure comprising at least two electroconductive layers, at least one of said electroconductive layers being provided within said heat-accumulating layer.

Still another object of the present invention is to provide a heater board, having a substrate, a heat-accumulating layer provided on said substrate, a plurality of electricity-heat converting elements provided on said heat-accumulating layer, and a matrix wiring portion connected electrically to said electricity-heat converting elements, said matrix wiring portion has a multi-layer structure comprising at least two electroconductive layers arranged through an insulating layer, and said heat-accumulating layer and said insulating layer being constituted of layers formed according to the same production process.

Still another object of the present invention is to provide a recording head provided with:

a liquid channel defining member for defining a liquid channel communicated to a discharging opening for discharging ink, and a base member having a plurality of electricity-heat converting elements for generating heat to be transmitted to the ink filling said liquid channel, and a functional element for controlling the current flowing through said electricity-heat converting elements, the matrix wiring portion having a multi-layer constitution connected electrically to said electricity-heat generating elements being provided between said plurality of electricity-heat converting elements and said functional element.

Still another object of the present invention is to provide a recording device provided with a recording head having:

a plurality of discharging openings for discharging ink, N×M electricity-heat converting elements for generating heat energy to be utilized for discharging ink through said discharging openings, a matrix wiring portion with a multi-layer constitution having M common wirings electrically connected to said electricity-heat converting elements commonly per N elements thereof, N common wirings electrically connected to said electricity-heat converting elements commonly per M elements thereof and an insulating layer, said N×M electricity-heat converting elements being provided on said insulating layer; and a driving means for supplying electrical signals selectively through said N common wirings and said M common wirings;

recording being performed by discharging ink through said discharging openings.

Still another object of the present invention is to provide a recording device provided with a recording head having:

a plurality of discharging openings for discharging ink,

N×M electricity-heat converting elements for generating heat energy to be utilized for discharging ink through said discharging openings, a functional element portion for controlling the current flowing through said electricity-heat converting elements, a matrix wiring portion with a multi-layer constitution provided between said N×M electricity-heat converting elements and said functional element portion and having M common wirings electrically connected to said electricity-heat converting elements commonly per N elements thereof and N common wirings electrically connected to said electricity-heat converting elements commonly per M elements thereof, and a driving means for supplying electrical signals selectively through said N common wirings and said M common wirings;

recording being performed by discharging ink through said discharging openings.

DETAILED DESCRIPTION OF THE PREFERRED EMBODIMENTS

Figure 1A:
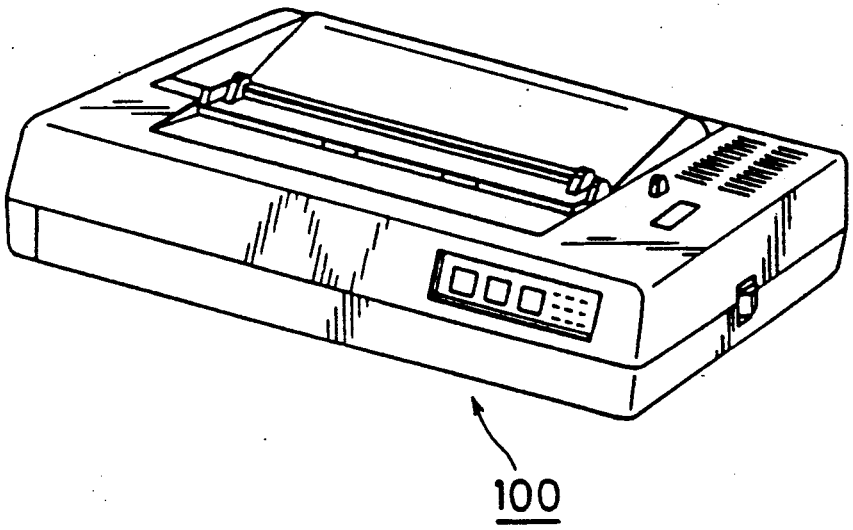
FIG. 1A PRIOR ART
FIG. 1A is a schematic perspective view of an ink jet printer to which the present invention is applicable.

In the following, the present invention is to be described by referring to the drawings, but the present invention is not limited to the embodiments as described below, but may have a constitution which can accomplish the object of the present invention.

Figure 4:
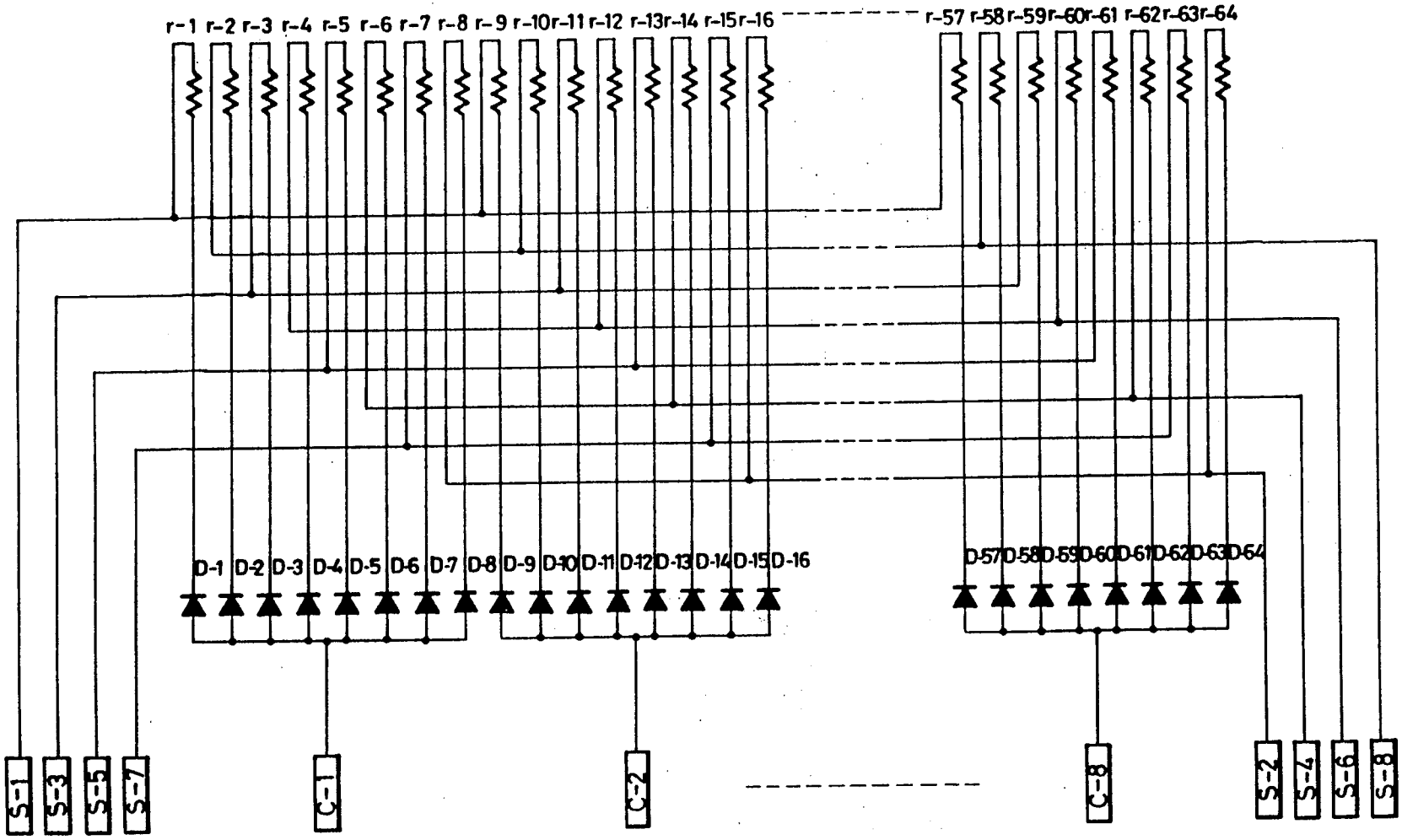
FIG. 4 is a matrix wiring circuit constitutional diagram by use of the diode array according to the present invention.

FIG. 4 is a schematic circuit constitutional diagram of the recording head according to the present invention. By referring to FIG. 4, the constitution of time sharing driving is described by taking an example of an ink jet recording head having 64 discharging openings. In the drawing, 64 discharging openings and corresponding electricity-heat converting elements are divided into groups each of 8, which are connected to group selection electrodes C1–C8, and further common signal selection electrodes S1–S8 are provided. For example, when ink is desired to be discharged through the eleventh discharging opening, C2 and S3 may be turned on, whereby current flows through the electricity-heat converting element r11 to generate heat.

Figure 5:
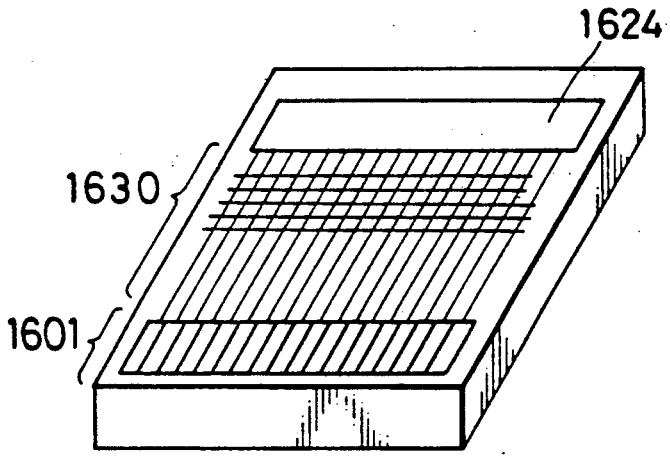
FIG. 5 is a schematic perspective view showing the heater board of the recording head according to the present invention.

FIG. 5 shows the heater board as the base member of the recording head having the circuit pattern as described above thereon, and a liquid channel forming member for forming the liquid channel for ink is laminated thereon to constitute an ink jet recording head. Numeral 1624 is a diode array having a plurality of diodes having rectifying characteristic as the functional element. Numeral 1630 is a matrix wiring portion, and 1601 is a heat-generating portion having a plurality of heaters.

Figure 6A:
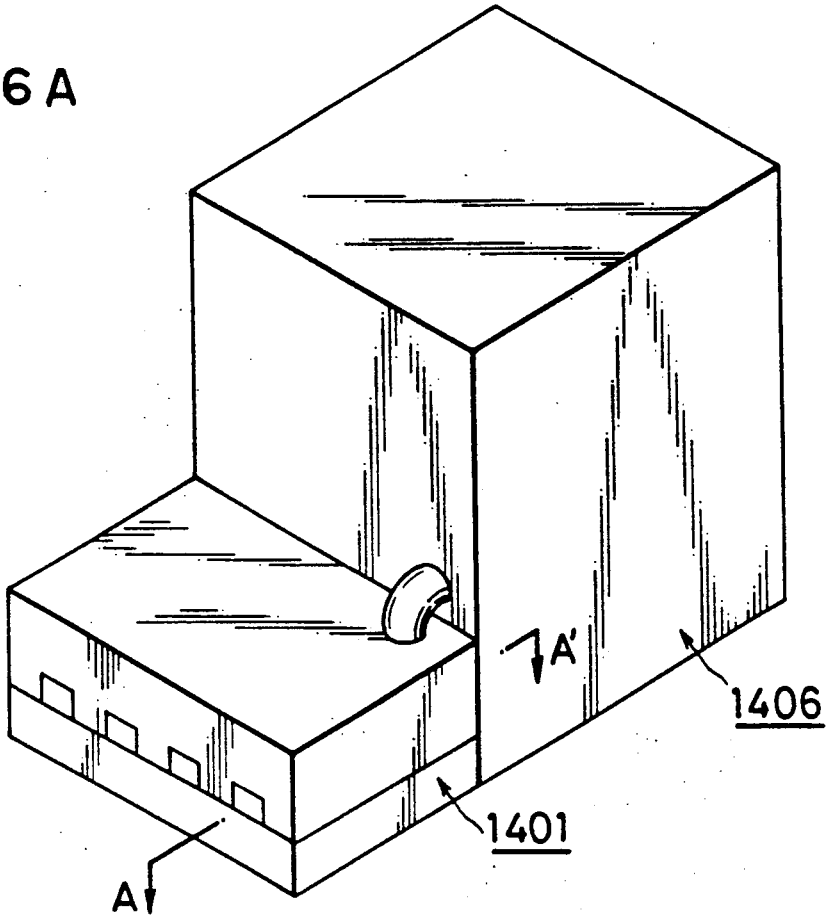
FIGS. 6A and 6B are schematic perspective views of the recording head according to the present invention.

FIG. 6A shows a recording head of the type which discharges ink substantially parallel to the heat-generating surface.

Figure 6B:
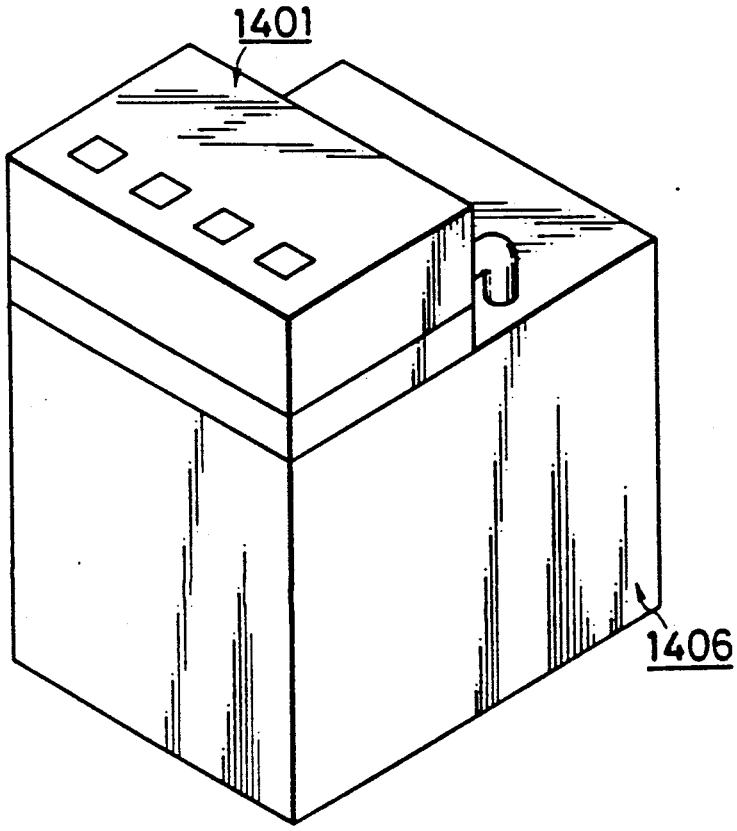

FIG. 6B is a recording head of the type which discharges ink in the direction crossed with the heat generating surface.

As shown in FIGS. 6A and 6B, these recording heads 1401 are equipped integrally with ink tanks 1406, and the present invention can be applied particularly suitably to the both.

Next, the most characteristic constitution of the present invention is to be described by referring to an example of the recording head shown in FIG. 6A.

Figure 7:
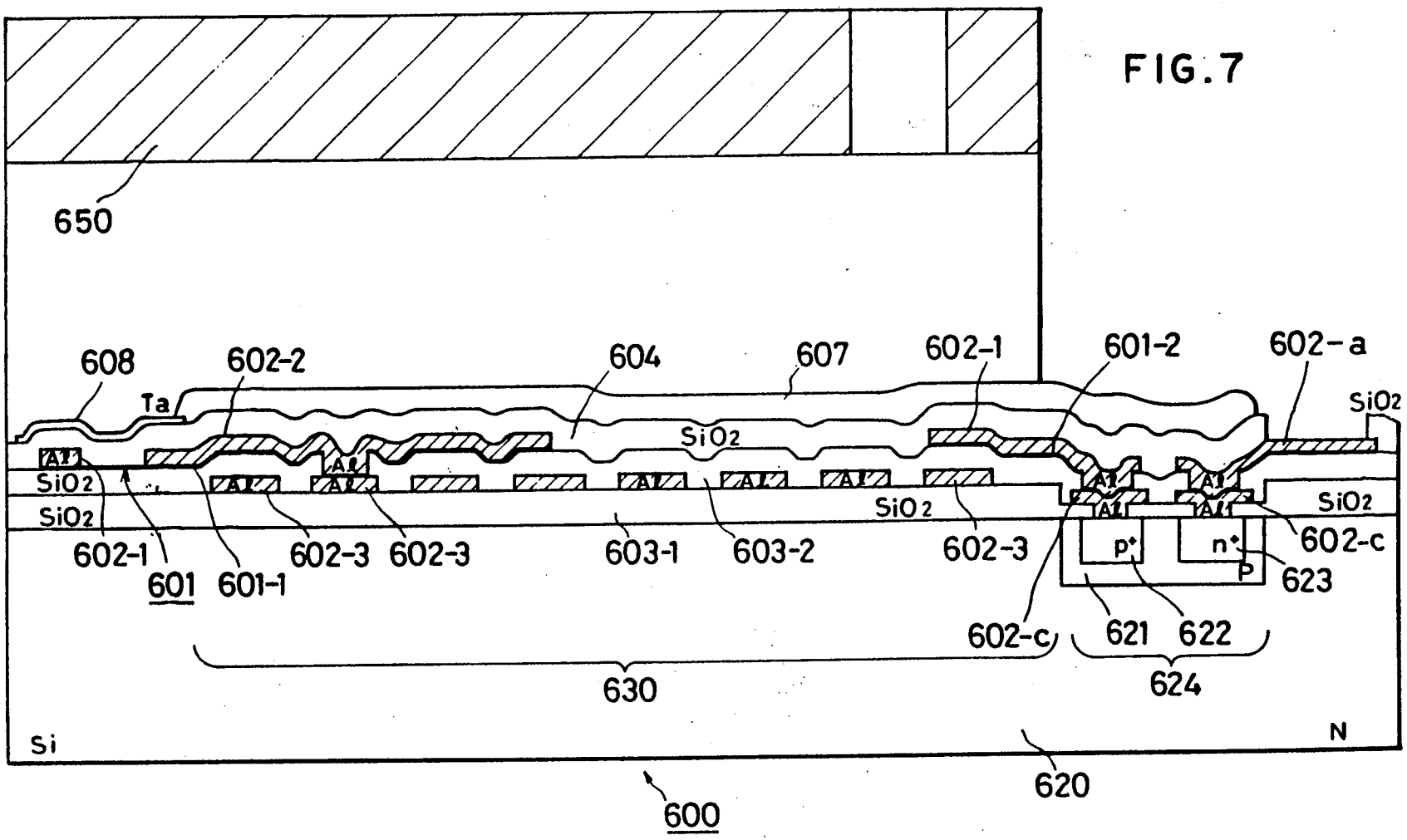
FIG. 7 is a schematic sectional view cut along the A—A' line in FIG. 6A.

FIG. 7 is a sectional view cut along the line A—A' in FIG. 6A. Numeral 620 is a substrate for forming a heater portion 601 as the electricity-heat converting element, a matrix wiring portion 630 and a diode portion 624 as the functional element, and here N-type silicon substrate is used. Otherwise, as the substrate 620, P-type silicon substrate, N-type silicon substrate having P-type or N-type epitaxially grown layer formed thereon, or P-type silicon substrate having P-type or N-type epitaxially grown layer formed thereon may be employed.

In this case, of the substrate 620, the region where the heater portion 601, the matrix wiring portion 630 and the diode portion 624 are formed should be desirably made higher in resistance in view of the dielectric strength by the driving voltage of the heater 601. For example, if the region is made an epitaxially grown layer region, the resistance value (specific resistance) can be varied by controlling the amount of the impurity introduced. Such impurity may be an atom belonging to the group III of the periodic table such as B, Ga, etc. when P-type is formed, or an atom belonging to the group V of the periodic table such as P, As, etc. when N-type is formed. The impurity concentration may be preferably $1\times10^{12}$ to $1\times10^{16}$ $cm^{-3}$, more preferably $1\times10^{12}$ to $1\times10^{15}$. The heat accumulating layers 603-1, 602-2 formed beneath the heater 601 may be suitably selected from materials having good heat accumulating characteristic and insulating property, and for example, there can be suitably used a single layer or multiple layers comprising inorganic materials such as oxides of silicon, titanium, vanadium, niobium, molybdenum, tantalum, tungsten, chromium, zirconium, hafnium, lanthanum, yttrium, manganese, aluminum, calcium, strontium, barium, etc. or high resistance nitrides of silicon, aluminum, boron, tantalum, etc., or organic materials such as epoxy resin, silicone resin, fluorine resin, polyimide, polyethyleneterephthalate, photosensitive resin, etc. Among them, silicon oxide (e.g. $SiO_2$) and silicon nitride (e.g. $Si_3N_4$) may be preferably used.

The heater 601 has a structure of a heat-generating resistance layer subjected to patterning and a pair of electrodes laminated, and is formed on the above heat-generating layer. It is provided in the number corresponding to recording picture elements, for example, in the same number as the N×M discharging openings (N, M are natural numbers of 2 or more).

The material suitably used as the heat-generating resistance layer may include metals such as tantalum, nichrome, hafnium, lanthanum, zirconium, titanium, tungsten, aluminum, molybdenum, niobium, chromium, vanadium, etc. or alloys of them or borides of them.

The matrix wiring portion 630 has common signal selection wirings 602-3 in number of N formed on the heat-accumulating layer 603-1, a heat accumulating layer 603-2 which plays a role as the interlayer insulating layer formed on said common signal selection wirings 602-3 in number of N, individual signal wirings 602-1 in number of N×M and individual signal wirings 602-2 in number of N×M formed on said heat accumulating layer 603-2, and forms a multi-layer wiring structure of these.

Here, the individual signal selection wiring 602-2 is one electrode of one electricity-heat converting element and connected to one common signal selection wiring 602-3 through the contact hole provided on the heat-accumulating layer 603-2. On the other hand, the individual signal wiring 602-1 is the other electrode of the above one electricity-heat converting element, and also connected to the anode electrode of the diode portion through the contact hole provided on the heat-accumulating layer 603-2.

Thus, by arranging mutually the wirings crossed with each other three-dimensionally, the occupied area can be made smaller.

Here, as the material to be used for wiring, Al, Cr, Ag, Au, Pt, Cu, etc. may be included.

The diode portion 624 is provided on the substrate 620 in the same number (N×M) as the heater 601.

In the present specification, even when built in within the substrate as in this embodiment, it should be noted that it is expressed as "provided on the substrate".

Thus, when a group among M groups is selected, erroneous actuation through flowing of current through the heater which should be made non-driven within the groups can be prevented.

Each unit cell of the diode portion of this embodiment is constituted of an anode region comprising a P-type high resistance region (P-region) 621 of low impurity concentration and a P-type low resistance region ($P^+$-region) 622 of high impurity concentration provided within said P-region 621 for forming an ohmic contact with the anode electrode 602-c; and a N-type low resistance region ($N^+$-region) of high impurity concentration 623 provided within the P-region 621 as a cathode region.

Of course, polarity of the diode should be selected appropriately depending on the polarity of signal applied to the heater 601. Further, the functional elements are not limited to a diode, but may be a transistor functioning as a rectifying element or a switching element.

Thus the structure having in sequence a heater portion, a matrix wiring portion and a function element portion in the lateral direction of the substrate involves the following excellent advantages.

That is, in the functional element portion, there shoud be no change in rectifying characteristic or erroneous actuation by the heat from the heater, and on the contrary the heat from the functional element portion must not give deleterious influence to ink.

By providing the matrix wiring portion 630 between the heater portion 601 and the diode portion 624 as the functional element portion, the distance between the heater and the diode can be adequately maintained to avoid the above risk.

Also, since the heat accumulating layer is utilized as the interlayer insulating layer of the matrix wiring portion also in the thickness direction of the substrate, it can be formed according to the same process, whereby not only the layer constitution as a whole does not become complicated, but also heat can be dispersed adequately due to the presence of a metal wiring which an electroconductive layer between the layers from the heat-generating region of the heat-generating resistance layer to the diode, to give a structure excellent in thermal transmission characteristic.

Further, since the lower layer wiring of the matrix wiring portion is formed within the heat-accumulating layer, unevenness due to step difference will appear with difficulty to the heat-generating surface side, namely the ink liquid channel side, and therefore design of the liquid channel resistance, etc. can be easily done.

Of course, since the space of the expensive single crystal silicon substrate can be effectively utilized, miniaturization, simplification and reduction in cost can be further promoted.

On the substrate surface having the heater portion, the matrix wiring portion and the diode portion and provided as described above, a protective layer 604 excellent in electrical insulating characteristic and thermal conductive characteristic is provided.

On the protective layer 604, on the heater, namely in the vicinity of the heat-generating portion, a cavitation resistance layer 608 is provided.

Similarly, an upper layer 607 is provided on the matrix wiring portion and the diode portion.

For the above protective layer 604 and the upper layer 607, the same material as the heat accumulating layer as described above can be used, and the functions can be also separated by forming the protective layer 604 and the upper layer 607 of different materials.

As the cavitation resistance layer 608, metals or alloys of Ti, Zr, Hf, Ta, V, Nb, Cr, Mo, W, Fe, Co, Ni, etc., or carbides, borides, silicides or nitrides of the above metals can be used.

Further, by adhering or pressure contacting a liquid channel forming member 650 defining a discharging opening for discharging ink and a liquid channel communicated to said discharging opening and supplying ink to the heat-generating portion, an ink jet recording head is constituted.

Accordingly, when the above upper layer 607 constitutes a part of the liquid channel, a material having the surface characteristic which can suitably select and design the liquid channel resistance, etc. is selected, but only the protective layer 604 having the above surface characteristic may be also used.

In FIG. 7 and other drawings, the respective layer constitutions are drawn schematicaly so as to be easily seen, but their thicknesses, lengths, etc. are designed in view of the characteristics as described above.

EXAMPLE

In the following, the method for preparing the recording head according to an example of the present invention is described by referring to the preparation steps.

First, the method for preparing the diode portion is described briefly by referring to FIG. 8. For example, as a first electroconductive type, a N-type single crystal Si substrate 720 was used. As shown in FIG. 8A, the silicon oxide film corresponding to the insulating layer of the substrate for forming head is formed by the thermal oxidation method. In this example, for making the heat accumulation layer 2.5 μm, first the thermally oxidized layer 703 is formed to 1.5 μm.

Figure 8A:
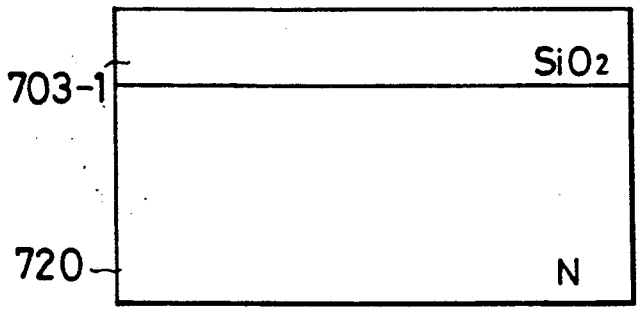
FIGS. 8A to 8E are schematic diagrams showing the preparation steps of the functional element portion of the heater board of the recording head according to the present invention.
Figure 8B:
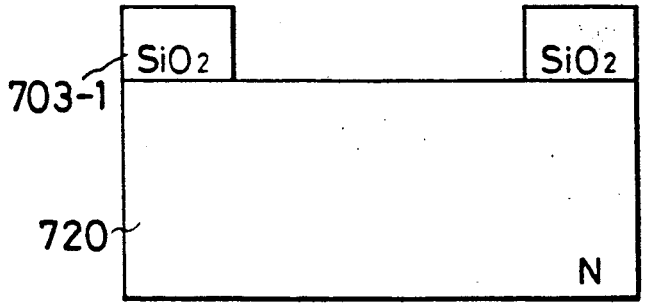
Figure 8C:
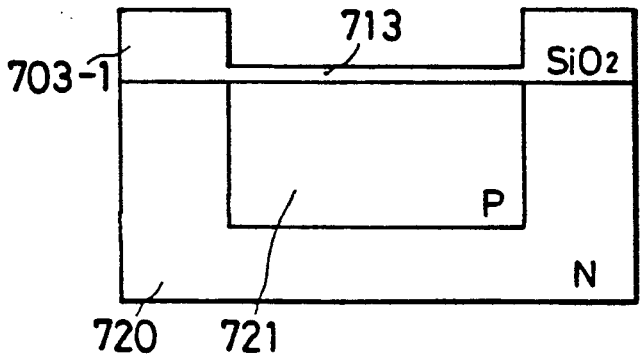
Figure 8D:
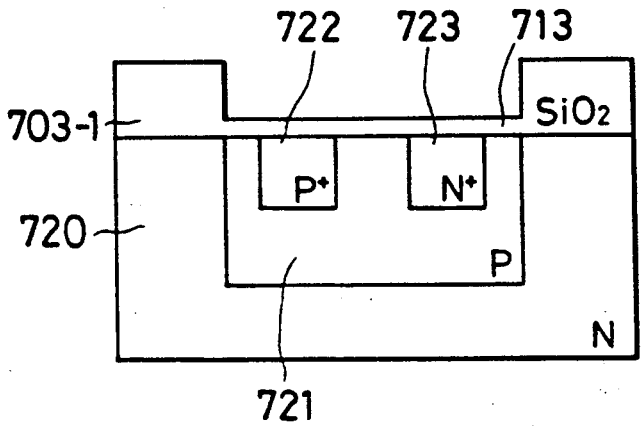

As shown in FIG. 8B, the oxidized layer 703 was subjected to etching treatment to form a portion for forming the diode. By having boron diffused into the layer, P region 721 with a low impurity concentration was formed, and a thin oxidized film 713 was formed thereon (FIG. 8C). Next, by further having boron diffused into the P region 721, P+ region 722 with a high impurity concentration of $1\times10^{16}$ to $1\times10^{18}$ $cm^{-3}$ (FIG. 8D) was formed, simultaneously with diffusion of phosphorus to form N+ region 723 with a high impurity concentration of $1\times10^{16}$ to $1\times10^{18}$ $cm^{-3}$. And, a part of the oxidized film 713 was removed and, after Al film was formed by vapor deposition, patterning was effected by photographic technique to form an electrode 702-C, thus forming a diode portion having the rectifying function as the functional element (FIG. 8E).

Figure 8E:
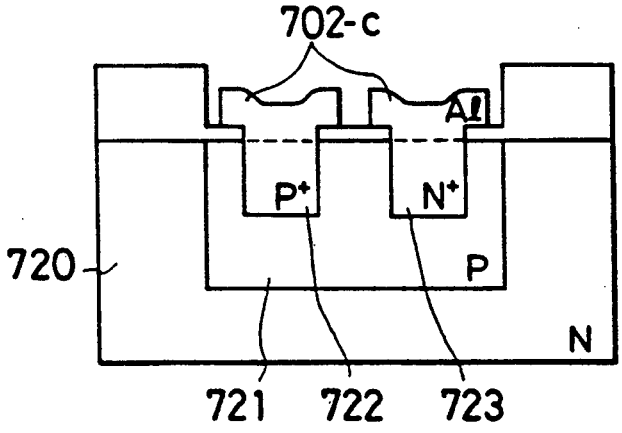
Figure 9A:
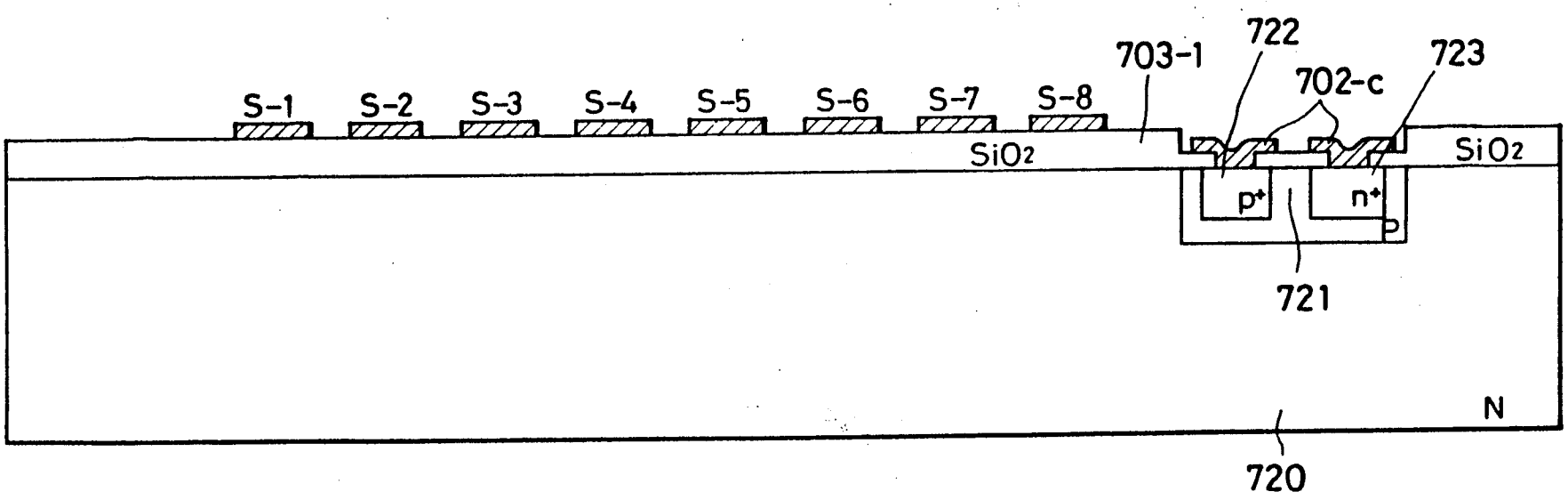
FIGS. 9A to 9C are schematic diagrams showing the preparation steps of the functional element of the heater board according to the present invention.

So that the heater board of the head may have a whole section as shown in FIG. 9A, common signal selection wirings for connecting electrically to one of the electrodes of the electricity-heat converting elements simultaneously with electrode formation of Al as described in FIG. 8E are formed on the $SiO_2$ film 703-1.

In this example, for constituting a recording head having 64 discharging openings, 64 electricity-heat converting elements are arranged, and therefore the common signal selection wirings were made 8 (S-1 to S-8).

Figure 9B:
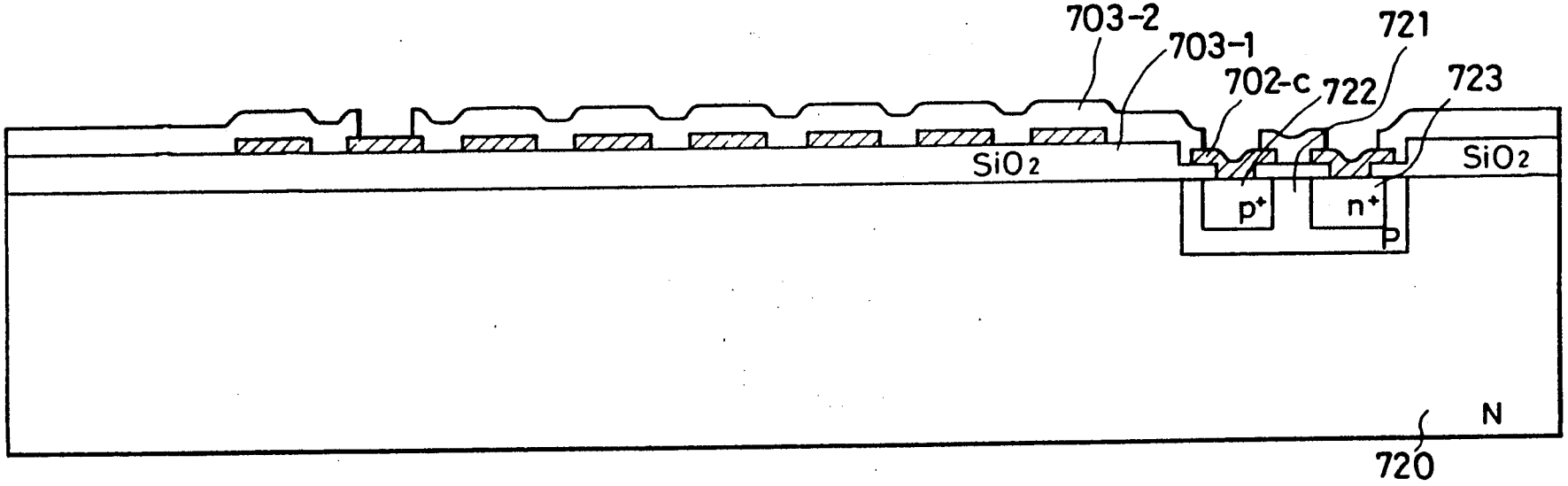

Then, as shown in FIG. 9B, the $SiO_2$ layer which becomes the interlayer insulating film was formed by the CVD method, and the $SiO_2$ layer was etched at predetermined positions to form contact holes. Through the contact holes, the electricity-heat converting elements are electrically connected to the common signal selection wirings.

Thus, the $SiO_2$ layer 703-2 with a layer thickness of 1 μm was formed and a heat accumulating layer with a layer thickness of 2.5 μm was formed.

Of a pair of electrodes in each electricity-heat converting element formed on the $SiO_2$ film 703-2, the individual signal wiring 702-1 connected to the group selection electrode side is connected to the connecting pad portion 702-a for connecting to the external driving circuit through the diode. On the other hand, of a pair of electrodes, the other signal selection wiring 702-2 is connected through the contact hole to the common signal selection wiring within the heat accumulating layer formed simultaneously with the anode and cathode electrodes of the diode forming the signal selection terminal. The wiring pattern of these electrodes was formed in a series of film forming-photolithographic steps as described above.

Figure 9C:
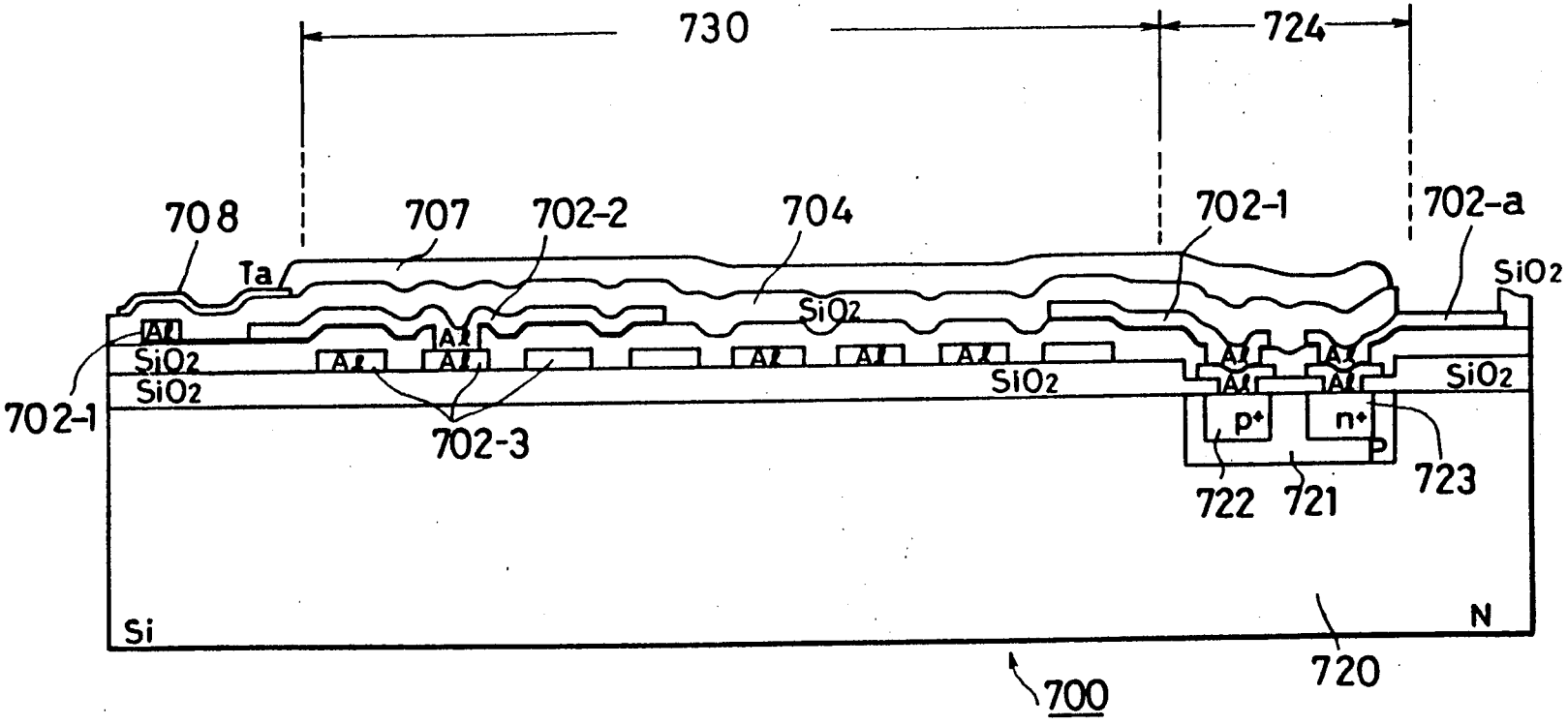
Figure 10:
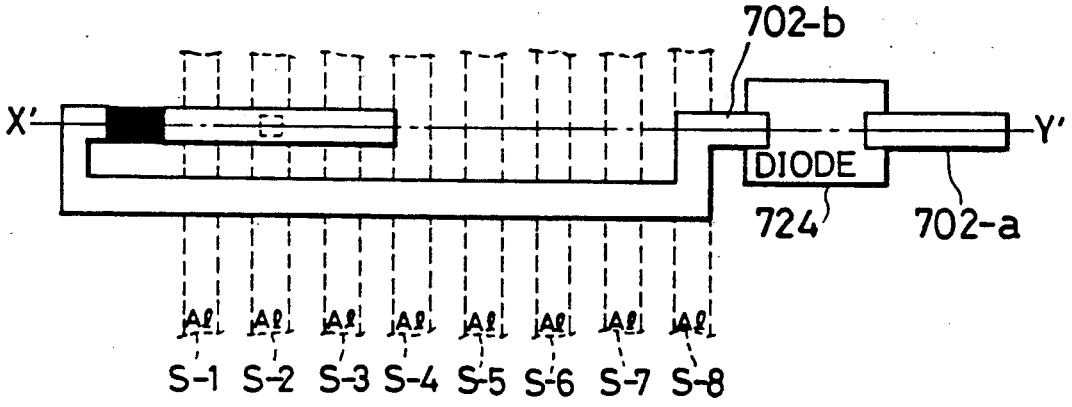
FIG. 10 is a schematic top view of a part of the heater board of the recording head according to the present invention.

FIG. 10 is a schematic top view as viewed from above of one unit of the heater board of the recording head shown in FIG. 9C, and the cross-section cut along the line X'-Y' is FIG. 9C as described above.

Next, the protective layer is described. As shown in FIG. 9C, a protective layer for shielding the ink and protecting oxidation, and also a preventive layer for preventing cavitation damage occurring during deforming were formed at the upper part of the electricity-heat converting element to form a heater board as the base member for the recording head.

At this time, for obtaining more preferably heat accumulating function and electrical insulating property, and further flatness for forming a part of the ink channel, the film thickness of the $SiO_2$ film 703-2 according to the CVD method is required to cover sufficiently the stepped difference created by Al electrode, and therefore determined depending on the film thickness of the Al layer. For example, when the film thickness of the Al film is 5000 Å, the thickness of the $SiO_2$ film 703-2 is required to be about 8000 Å or more. On the other hand, when the Al layer is 1 μm, since the thickness of the $SiO_2$ layer 703-2 is required to be about 1.5 μm, the $SiO_2$ film 703-1 by thermal oxidation must be suppressed to 1.0 μm to make the thickness of the heat-accumulating layer as a whole 2.5 μm, so that the heat content flowing upwardly of the heat-generating member and that flowing downwardly may not be unbalanced.

Then, a high resistance heat-generating resistance layer 701-1 comprising a Ta-Al alloy was vapor deposited, and an electroconductive layer of low resistance comprising Al was vapor deposited thereon.

Then, the heat-generating resistance layer and the Al layer were subjected to patterning according to the photolithographic technique to form 64 electricity-heat converting elements.

The protective layer 704 comprising $SiO_2$ was formed by the CVD method. The cavitation resistance layer 708 comprising Ta was formed by vapor deposition.

Further, in this example, an ink resistant layer 707 comprising a material different from the protective layer 704, namely a photosensitive resin was coated as the upper layer at the portion other than the vicinity of the heat-generating portion and cured by photoirradiation.

By providing a liquid channel forming member as shown in FIGS. 6A and 6B on the heater board formed as described above, the discharging opening and liquid channel of ink were defined to complete a recording head.

Figure 1B:
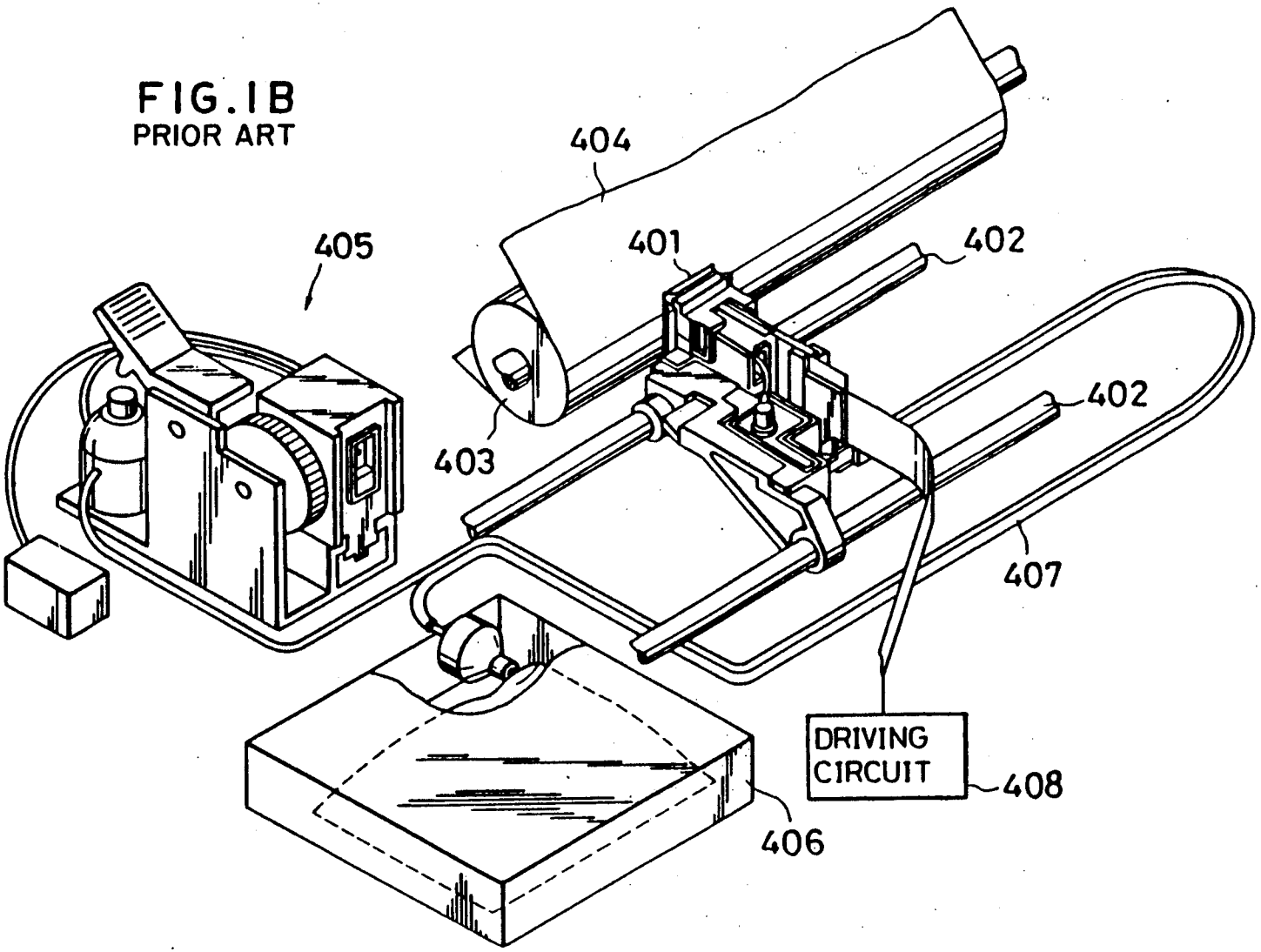
FIG. 1B PRIOR ART
FIG. 1B is a schematic exploded view for illustration of the main constitution of the ink jet printer in FIG. 1A.
Figure 2A:
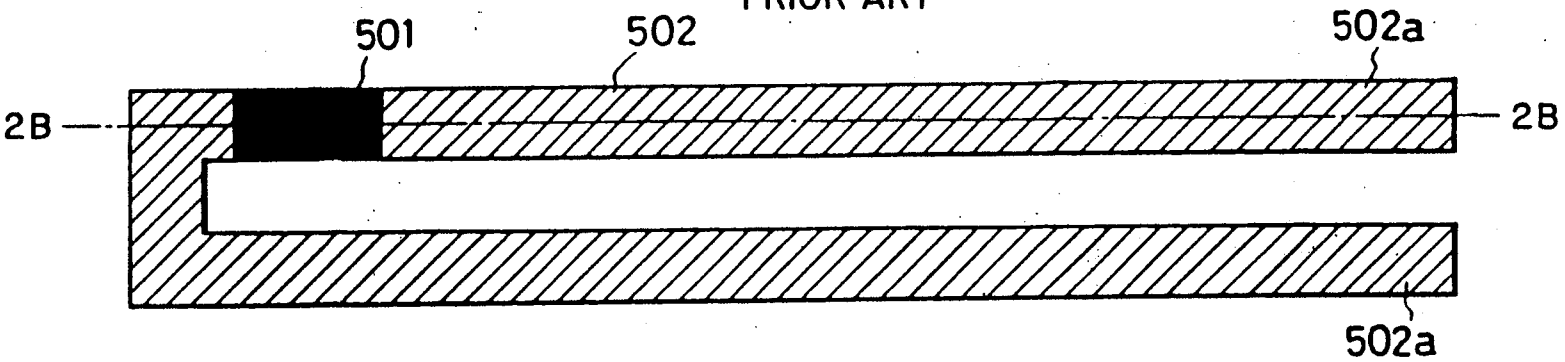
FIG. 2A PRIOR ART
FIG. 2A is a schematic plan view of the heater board of the ink jet recording head.
Figure 2B:
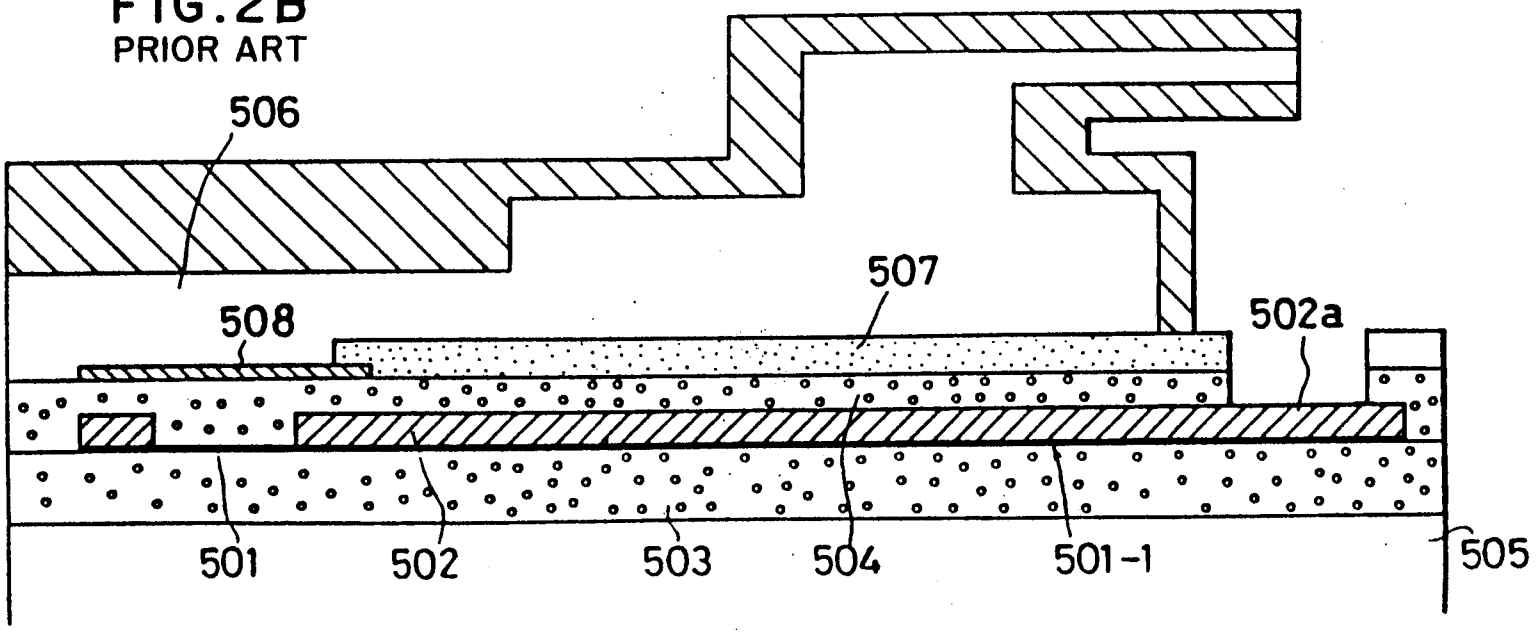
FIG. 2B PRIOR ART
FIG. 2B is a schematic sectional view cut along the line X-Y in FIG. 2A.
Figure 3:
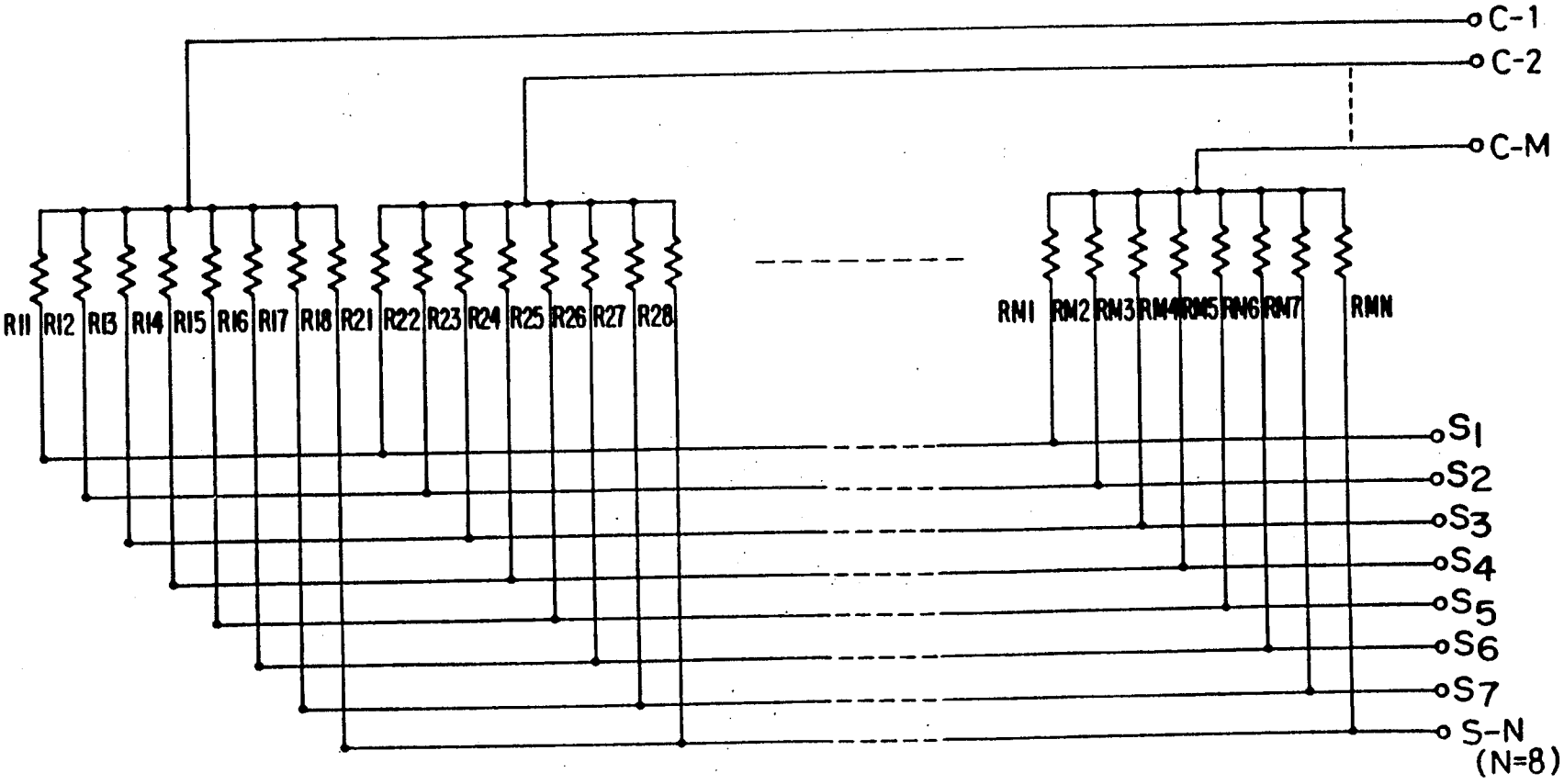
FIG. 3 PRIOR ART
FIG. 3 is a wiring circuit constitutional diagram of the recording head which can be driven by time sharing with a matrix wiring.

The recording head completed was mounted on an ink jet recording device with a constitution as shown in FIG. 1B, and time sharing driving with 8×8 was performed, whereby stable discharging could be performed for a long time.

As described above, according to the present invention, one wiring of multi-layer wirings for sharing driving is formed within the heat accumulating layer, and therefore the preparation steps of formation of the accumulating layer et seq are entirely the same as in the ink jet recording head having no diode for sharing driving mounted thereon of the prior art.

For this reason, it is possible to make common the production lines, and new installation investment can be only for the diode preparation step, whereby it has become possible to suppress not only the material cost but also the production cost at low level.

What is claimed is:

1. A recording head comprising:

a liquid channel defining member for defining a plurality of liquid channels to be supplied with ink and communicating with discharging openings for discharging ink, and a base member having a plurality of electricity-heat converting elements for generating heat to be transmitted to the ink in said liquid channels, each converting element having a heat-generating surface, and a matrix wiring portion connected electrically to said electricity-heat converting elements, respectively, said matrix wiring portion having a multi-layer constitution having a first wiring and a second wiring provided through an insulating layer on said first wiring, and said plurality of electricity-heat converting elements being provided on said insulating layer.

2. A recording head according to claim 1, wherein said discharging openings are is provided at a position so that the ink may be discharged in a direction substantially parallel to the heat-generating surface.

3. A recording head according to claim 1, wherein said discharging openings are provided at a position so that the ink may be discharged in a direction at an angle between a direction orthogonal to and a direction parallel to the heat-generating surface.

4. A recording head according to claim 1, further comprising an integral ink tank for housing the ink to be supplied to said liquid channels.

5. A recording head according to claim 1, wherein said electricity-heat converting elements each have a heat-generating resistance layer and electrodes.

6. A recording head according to claim 1, wherein an insulating protective layer is provided on the upper part of said electricity-heat converting elements and said matrix wiring portion.

7. A recording head according to claim 1, further comprising an insulating layer beneath said first wiring.

8. A recording head according to claim 1 or claim 7, wherein said insulating layers are formed of silicon oxide or silicon nitride.

9. A recording head according to claim 1, wherein said base member further has a functional element for restricting the current flowing through said electricity-heat converting elements.

10. A recording head according to claim 9, wherein said functional element is a diode.

11. A recording head according to claim 9, wherein said functional element is a transistor.

12. A recording head according to claim 1, wherein said plurality of electricity-heat converting elements are divided into a plurality of groups each of a predetermined number and subjected to block driving.

13. A recording head according to claim 1, wherein said plurality of electricity-heat converting elements are subjected to time sharing driving.

14. A recording head according to claim 1, wherein said matrix wiring portion includes N×M individual wirings connecting M of said electricity-heat converting elements with each of N common wirings and connecting N of said converting elements with each of M common wirings.

15. A recording head according to claim 14, wherein said matrix wiring portion includes one wiring which is connected to N×M electricity-heat converting elements, respectively, and the other wiring which is connected to N×M diodes, respectively.

16. A recording head comprising;

a liquid channel defining member for defining a plurality of liquid channels to be supplied with ink and communicating with discharging openings for discharging the ink, and a substrate comprising a plurality of electricity-heat converting elements for generating heat to be transmitted to the ink in said liquid channels, said electricity-heat converting elements being arranged on a heat-accumulating layer, said recording head having a matrix wiring portion arranged on said substrate and electrically connected to said electricity-heat converting elements respectively, said matrix wiring portion having a multi-layer wiring structure comprising at least two electroconductive layers, at least one of said electroconductive layers being provided within said heat-accumulating layer.

17. A recording head according to claim 16, wherein the electroconductive layers provided within said heat-accumulating layer are common wirings connected electrically commonly to said plurality of electricity-heat converting elements.

18. An article comprising:

a substrate;

a heat-accumulating layer provided on said substrate;

a plurality of electricity-heat converting elements provided on said heat-accumulating layer; and a matrix wiring portion connected electrically to said electricity-heat converting elements, wherein said matrix wiring portion has a multi-layer structure comprising at least two electroconductive layers and an insulating layer provided therebetween, and said heat-accumulating layer and said insulating layer being constituted of layers formed in the same production step.

19. A heater board according to claim 18, wherein said layers are formed of silicon oxide or silicon nitride.

20. A heater board according to claim 18, further comprising a functional element for restricting the current flowing through said electricity-heat converting elements.

21. A recording head comprising:

a liquid channel defining member for defining a plurality of liquid channels to be supplied with ink communicating with discharging openings for discharging the ink;

a base member having a plurality of electricity-heat converting elements for generating heat to be transmitted to the ink in said liquid channels, each converting element having a heat generating surface and a functional element for controlling the current flowing through said electricity-heat converting elements, and a matrix wiring portion having a multi-layer constitution connected electrically to said electricity-heat converting elements and being provided between said plurality of electricity-heat converting elements and said functional element.

22. A recording head according to claim 21, wherein said discharging openings are provided at a position so that the ink may be discharged in a direction substantially parallel to the heat-generating surface.

23. A recording head according to claim 21, wherein said discharging openings at provided at a position so that the ink may be discharged in a direction substantially crossed with the heat-generating surface.

24. A recording head according to claim 21, further comprising an integral ink tank for housing the ink to be supplied to said liquid channels.

25. A recording head according to claim 21, wherein said electricity-heat converting element has a heat-generating resistance layer and electrodes.

26. A recording head according to claim 21, wherein an insulating protective layer is provided on the upper part of said electricity-heat converting elements and said matrix wiring portion.

27. A recording head according to claim 21, wherein said recording head has a heat-accumulating layer which also functions as an interlayer insulating layer of said matrix wiring portion.

28. A recording head according to claim 21 or claim 27, wherein said heat-accumulating layer is formed of silicon oxide or silicon nitride.

29. A recording head according to claim 21, wherein said base member further has a functional element for restricting the current flowing through said electricity-heat converting elements.

30. A recording head according to claim 29, wherein said functional element is a diode.

31. A recording head according to claim 29, wherein said functional element is a transistor.

32. A recording head according to claim 21, wherein said plurality of electricity-heat converting elements are divided into a plurality of groups each of a predetermined number and subjected to block driving.

33. A recording head according to claim 21, wherein said plurality of electricity-heat converting elements are subjected to time sharing driving.

34. A recording head according to claim 21, wherein said matrix wiring portion includes N×M individual wirings connecting M of said electricity-heat converting elements with each of N common wirings and connecting N of said converting elements with each of M common wirings.

35. A recording head according to claim 34, wherein said matrix wiring portion includes one wiring which is connected to N×M electricity-heat converting elements, respectively, and the other wiring which is connected to N×M diodes, respectively.

36. A recording device provided with a recording head, said recording head comprising:

a plurality of discharging openings for discharging ink;

N×M electricity-heat converting elements for generating heat energy to be utilized for discharging the ink through said discharging openings;

a matrix wiring portion with a multi-layer constitution having N common wirings each electrically connected to M of said electricity-heat converting elements, N×M individual wirings each electrically connected to one of said electricity-heat converting elements and an insulating layer on one of said N common wirings and said N×M individual wirings, the other of said N common wirings and said N×M individual wirings being provided through said insulating layer, said N×M electricity-heat converting elements being provided on said insulating layer; and a driving means for supplying electrical signals selectively through said N common wirings and said N×M individual wirings.

37. A recording device according to claim 36, wherein said driving means supplies electrical signals for driving said electricity-heat converting elements by time sharing.

38. A recording device provided with a recording head, said recording head comprising:

a plurality of discharging openings for discharging ink;

N×M electricity-heat converting elements for generating heat energy to be utilized for discharging the ink through said discharging openings;

a functional element portion for controlling the current flowing through said electricity-heat converting elements;

a matrix wiring portion with a multi-layer constitution provided between said N×M electricity-heat converting elements and said functional element portion, said matrix wiring portion having N common wirings each electrically connected to M of said electricty-heat converting elements and N×M individual wirings each electrically connected to one of said electricity-heat converting elements; and a driving means for supplying electrical signals selectively through said N common wirings and said N×M individual wirings.

39. A recording device according to claim 38, wherein said driving means supplies electrical signals for driving said electricity-heat converting elements by time sharing.

40. An article comprising:

a base member having a plurality of electricity-heat converting elements for generating heat to be transmitted to ink supplied in a plurality of liquid channels communicating with discharge openings for discharging the ink, each converting element having a heat-generating surface, and a matrix wiring portion connected electrically to said electricity-heat converting elements, respectively, said matrix wiring portion having a multi-layer constitution having a first wiring and a second wiring provided through an insulating layer on said first wiring, and said plurality of electricity-heat converting elements being provided on said insulating layer.

41. An article comprising:

a substrate comprising a plurality of electricity-heat converting elements for generating heat to be transmitted to ink supplied in a plurality of liquid channels communicating with discharging openings for discharging the ink, said electricity-heat converting elements being arranged on a heat-accumulating layer;

and having a matrix wiring portion arranged on said substrate and electrically connected to said electricity-heat converting elements respectively, said matrix wiring portion having a multi-layer wiring structure comprising at least two electroconductive layers, at least one of said electroconductive layers being provided within said heat-accumulating layer.

42. A recording device comprising:

a liquid channel defining member for defining a plurality of liquid channels to be supplied with ink and communicating with discharging openings for discharging the ink; and a substrate comprising a plurality of electricity-heat converting elements for generating heat to be transmitted to the ink in said liquid channels, said electricity-heat converting elements being arranged on a heat-accumulating layer; and a matrix wiring portion arranged on said substrate and electrically connected to said electricity-heat converting elements respectively, said matrix wiring portion having a multi-layer wiring structure comprising at least two electroconductive layers, at least one of said electroconductive layers being provided within said heat-accumulating layer.

43. A recording device according to claim 42, further comprising means for carrying a recording medium.

44. A recording device according to claim 42, wherein said recording device is one of a copying machine, facsimile machine, word processor, and a printer.

45. A recording head comprising:

a substrate;

a liquid channel defining member for defining a plurality of liquid channels to be supplied with ink and communicating with discharging openings for discharging ink;

a heat-accumulating layer provided on said substrate;

a plurality of electricity-heat converting elements provided on said heat-accumulating layer; and a matrix wiring portion connected electrically to said electricity-heat converting elements, wherein said matrix wiring portion has a multi-layer structure comprising at least two electroconductive layers and an insulating layer provided therebetween, and said heat-accumulating layer and said insulating layer being constituted of layers formed in the same production step.

46. A recording device comprising:

a substrate;

a liquid channel defining member for defining a plurality of liquid channels to be supplied with ink and communicating with discharging openings for discharging ink;

a heat-accumulating layer provided on said substrate;

a plurality of electricity-heat converting elements provided on said heat-accumulating layer; and a matrix wiring portion connected electrically to said electricity-heat converting elements, wherein said matrix wiring portion has a multi-layer structure comprising at least two electroconductive layers and an insulating layer provided therebetween, and said heat-accumulating layer and said insulating layer being constituted of layers formed in the same production step.

47. A recording device according to claim 46, further comprising means for carrying a recording medium.

48. A recording device according to claim 46, wherein said recording device is one of a copying machine, facsimile machine, word processor, and a printer.

49. An article comprising:

a base member having a plurality of electricity-heat converting elements for generating heat to be transmitted to supplied ink in a plurality of liquid channels communicating with discharging openings for discharging ink, each converting element having a heat generating surface and a functional element for controlling the current flowing through said electricity-heat converting elements, and a matrix wiring portion having a multi-layer constitution connected electrically to said electricity-heat converting elements and being provided between said plurality of electricity-heat converting elements and said functional element.

50. A recording device according to claim 36, further comprising means for carrying a recording medium.

51. A recording device according to claim 36, wherein said recording device is one of a copying machine, facsimile machine, word processor, and a printer.

52. A recording device according to claim 38, further comprising means for carrying a recording medium.

53. A recording device according to claim 38, wherein said recording device is one of a copying machine, facsimile machine, word processor, and a printer.

54. A recording device comprising:

a recording head comprising:

a liquid channel defining member for defining a plurality of liquid channels to be supplied with ink and communicating with discharging openings for discharging ink, and a base member having a plurality of electricity-heat converting elements for generating heat to be transmitted to the ink in said liquid channels, each converting element having a heat-generating surface, and a matrix wiring portion connected electrically to said electricity-heat converting elements, respectively, said matrix wiring portion having a multi-layer constitution having a first wiring and a second wiring provided through an insulating layer on said first wiring, and said plurality of electricity-heat converting elements being provided on said insulating layer; and a driving means for supplying electrical signals selectively to said electricity-heat converting elements.

55. A recording device according to claim 54, further comprising means for carrying a recording medium.

56. A recording device according to claim 54, wherein said recording device is one of a copying machine, facsimile machine, word processor, and a printer.

57. A recording device comprising:

a recording head comprising:

a liquid channel defining member for defining a plurality of liquid channels to be supplied with ink communicating with discharging openings for discharging the ink, a base member having a plurality of electricity-heat converting elements for generating heat to be transmitted to the ink in said liquid channels, each converting element having a heat generating surface and a functional element for controlling the current flowing through said electricity-heat converting elements, and a matrix wiring portion having a multi-layer constitution connected electrically to said electricity-heat converting elements and being provided between said plurality of electricity-heat converting elements and said functional elements; and a driving means for supplying electrical signals selectively to said electricity-heat converting elements.

58. A recording device according to claim 57, further comprising means for carrying a recording medium.

59. A recording device according to claim 57, wherein said recording device is one of a copying machine, facsimile machine, word processor, and a printer.

60. A recording device comprising:

a recording head comprising:

a liquid channel defining member for defining a plurality of liquid channels to be supplied with ink and communicating with discharging openings for discharging the ink, and a substrate comprising a plurality of electricity-heat heat converting elements for generating heat to be transmitted to the ink in said liquid channels, said electricity-heat converting elements being arranged on a heat-accumulating layer, said recording head having a matrix wiring portion arranged on said substrate and electrically connected to said electricity-heat converting elements respectively, said matrix wiring portion having a multi-layer wiring structure comprising at least two electroconductive layers, at least one of said electroconductive layers being provided within said heat-accumulating layer; and a driving means for supplying electrical signals selectively to said electricity-heat converting elements.

61. A recording device according to claim 60, further comprising means for carrying a recording medium.

62. A recording device according to claim 60, wherein said recording device is one of a copying machine, facsimile machine, word processor, and a printer.

63. A recording device comprising:

a recording head comprising:

a substrate, a liquid channel defining member for defining a plurality of liquid channels to be supplied with ink and communicating with discharging openings for discharging ink, a heat-accumulating layer provided on said substrate, a plurality of electricity-heat converting elements provided on said heat-accumulating layer, and a matrix wiring portion connected electrically to said electricity-heat converting elements, wherein said matrix wiring portion has a multi-layer structure comprising at least two electroconductive layers and an insulating layer provided therebetween, and said heat-accumulating layer and said insulating layer being a single layer formed in the same production step; and a driving means for supplying electrical signals selectively to said electricity-heat converting elements.

64. A recording device according to claim 63, further comprising means for carrying a recording medium.

65. A recording device according to claim 63, wherein said recording device is one of a copying machine, facsimile machine, word processor, and a printer.

* * * * *

UNITED STATES PATENT AND TRADEMARK OFFICE

CERTIFICATE OF CORRECTION

PATENT NO. : 5,081,474

DATED : January 14, 1992

INVENTOR(S) : MAKOTO SHIBATA, ET AL.

It is certified that error appears in the above-identified patent and that said Letters Patent is hereby corrected as shown below:

COLUMN 2

Line 54, "Togonoh et al" should read --Toganoh et al.--.

COLUMN 3

Line 54, "head." should read --the head.--.

COLUMN 5

Line 10, "ink, N×M" should read --ink, ¶ N×M--.
Line 62, "line X-Y" should read --line 2B-2B--.

COLUMN 8

Line 51, "which" should read --with--.

COLUMN 9

Line 30, "schematicaly" should read --schematically--.

COLUMN 10

Line 37, "protecting" should read --protecting against--.

COLUMN 11

Line 29, "suppress" should read --reduce--.
Line 51, "is" should be deleted.

UNITED STATES PATENT AND TRADEMARK OFFICE

CERTIFICATE OF CORRECTION

PATENT NO. : 5,081,474

DATED : January 14, 1992

INVENTOR(S) : MAKOTO SHIBATA, ET AL.

It is certified that error appears in the above-identified patent and that said Letters Patent is hereby corrected as shown below:

COLUMN 13

Line 1, "A heater board" should read --An article--.
Line 3, "A heater board" should read --An article--.
Line 29, "at provided" should read --are provided--.
Line 31, "crossed" should read --orthogonal--.
Line 36, "element has" should read --elements each have--.

COLUMN 17

Line 33, "heat" (first occurrence) should be deleted.

Signed and Sealed this

Fifteenth Day of June, 1993

Michael K. Kirk

*Attest:*

MICHAEL K. KIRK

*Attesting Officer*

*Acting Commissioner of Patents and Trademarks*